US005461407A

United States Patent [19]

Robertson et al.

[11] Patent Number: 5,461,407

[45] Date of Patent: Oct. 24, 1995

[54] MARKING METHOD AND APPARATUS USING GAS ENTRAINED ABRASIVE PARTICLES

[75] Inventors: John A. Robertson, Chillicothe; Ken R. Vaughn, Kingston, both of Ohio

[73] Assignee: Telesis Marking Systems, Inc., Circleville, Ohio

[21] Appl. No.: 938,995

[22] Filed: Sep. 2, 1992

[51] Int. Cl.[6] ..... B41J 2/11; B41J 2/18

[52] U.S. Cl. ..... 347/82; 347/84

[58] Field of Search ..... 347/82, 84

[56] References Cited

U.S. PATENT DOCUMENTS

| | | | |
|---|---|---|---|
| 3,570,275 | 3/1971 | Weber et al. | 347/82 X |
| 3,805,274 | 4/1974 | Kashio | 347/82 |
| 3,873,769 | 3/1975 | Cotter | 178/18 |
| 3,903,526 | 9/1975 | Cotter | 346/21 |
| 4,190,844 | 2/1980 | Taylor | 347/82 |

*Primary Examiner*—Fred L. Braun

*Attorney, Agent, or Firm*—Mueller and Smith

[57] ABSTRACT

Marking apparatus is provided for carrying out the marking of programmed character strings upon brittle surfaces such as glass. The lines forming the characters are generated by a gas entrained stream of abrasive particles which are expressed from the opening of a nozzle located in close adjacency with the surface being marked. Switching of this abrasive particle string between marking and non-marking orientations is carried out by a diversionary flow of gas under pressure which is expressed into the stream at a rate effective to integrate with the abrasive particle and divert the marking stream away from a marking axis. A suction port is provided which removes particles subsequent to marking or having been diverted to a collection location. In one embodiment, the nozzle from which the marking particulate stream is expressed is maneuvered between lifted or retracted positions and marking positions in close adjacency with the surface being marked. As the nozzle is retracted, the particle stream issuing therefrom is diverted by the diversionary stream flow. To improve the switching action, a ledge is provided opposite the diversionary gas source. This ledge receives diverted particles for disposition through the noted suction port.

20 Claims, 6 Drawing Sheets

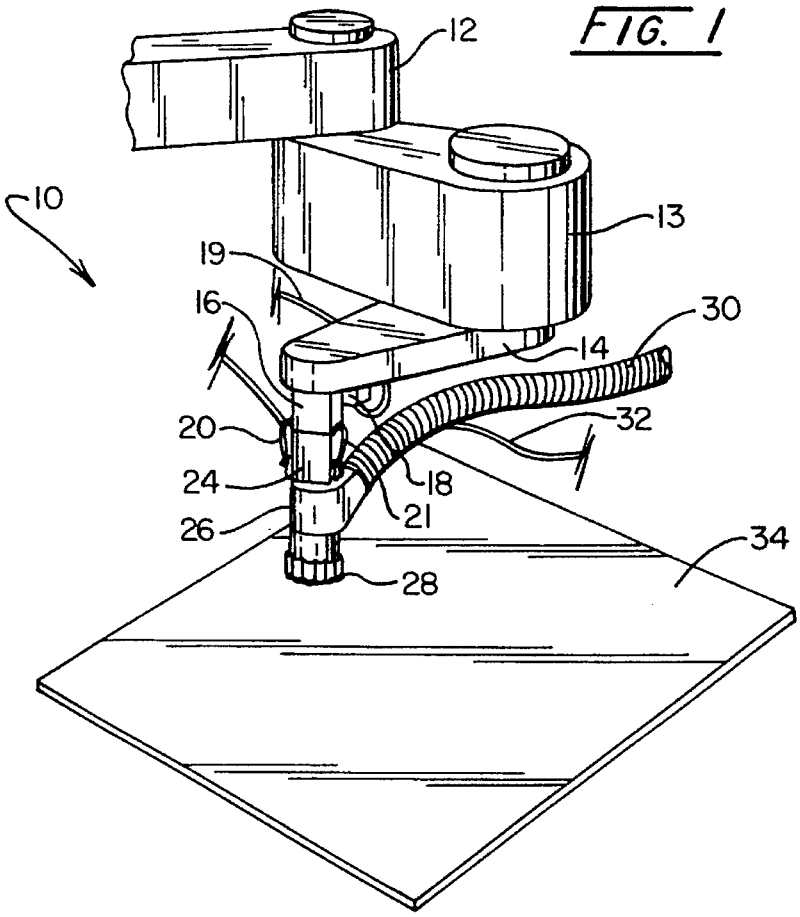
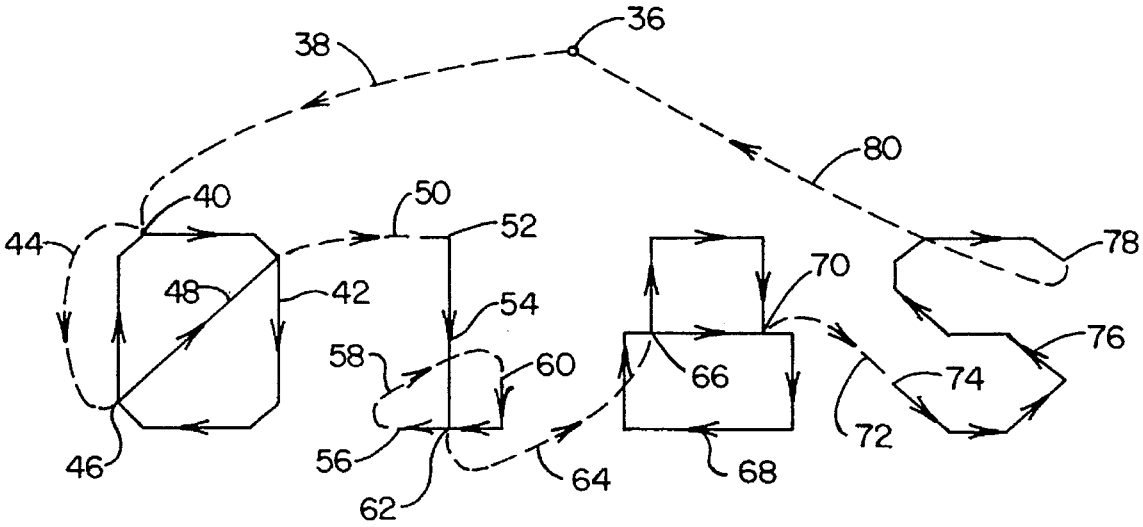
FIG. 2

116
122
118
124
114
126
120
130
128
112
92
98
154
90
96
102
152
104
150
146
140
106
136
132
138
94
100
142
144
148
108
110
134

166
162
170
172
188
190
160
168
180
226
176
192
174
178
184
186
200
196
210
202
224
220
182
198
204
222
206
178'
212
218
208
214
164
182'
194
216

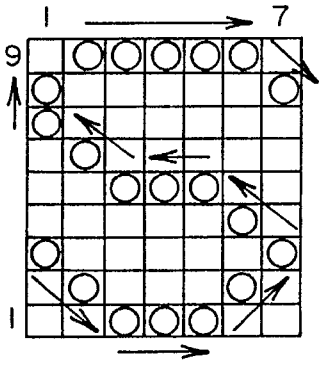
FIG. 8
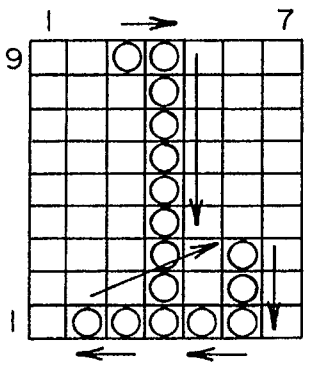
FIG. 9
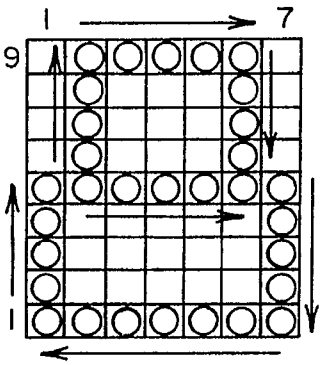
FIG. 10
FIG. 11
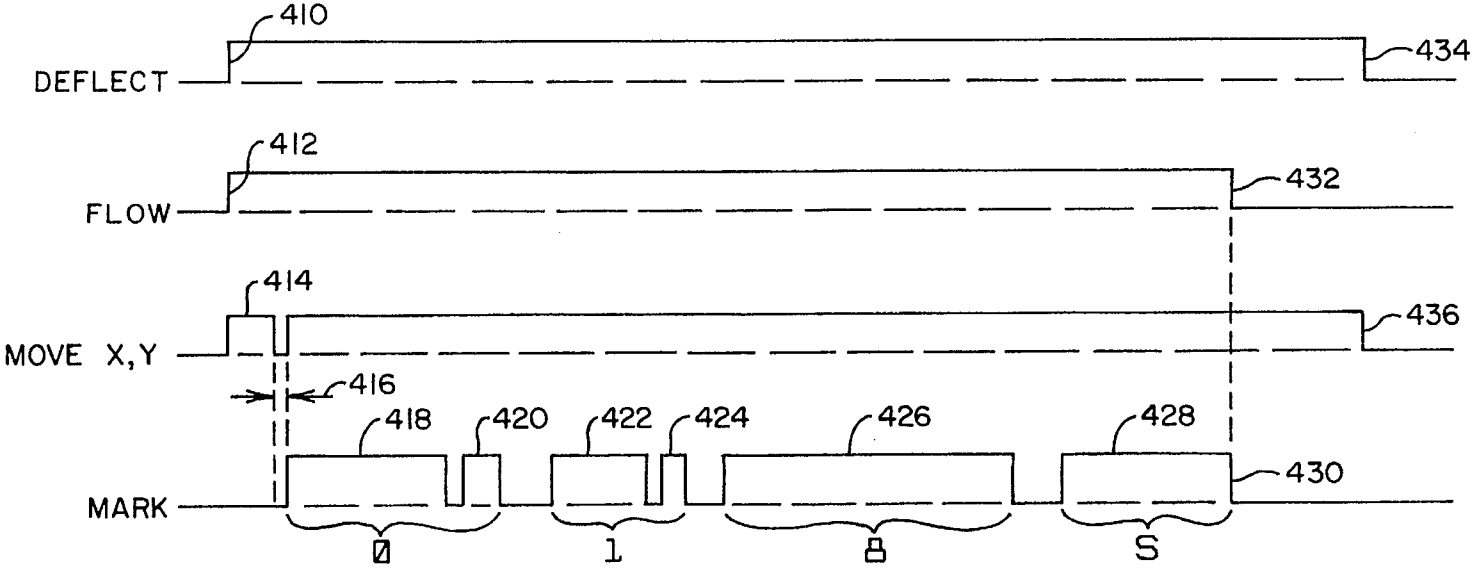
FIG. 7

MARKING METHOD AND APPARATUS USING GAS ENTRAINED ABRASIVE PARTICLES

BACKGROUND OF THE INVENTION

As the process control of manufacturing has improved, industry has sought efficient techniques for uniquely identifying products. This call for identification not only is concerned with the application of sequential, alpha-numeric strings to completed products, but also has application to component pans of fabrications such as automobiles and piece pans which are progressing through an industrial process.

The generation of computer selected character strings on piece parts which are of sufficient permanence and quality with adequate marking rapidity so as to permit the use of the marking process concurrently during production procedures has posed an elusive goal to investigators. A successful procedure and apparatus for marking unique computer generated character sequences upon the surfaces of somewhat maleable materials such as metals and plastics has been described in 1985 in U.S. Pat. No. 4,506,999 by Robertson, entitled "Program Controlled Pin Matrix Embossing Apparatus". This patent describes a computer driven dot matrix marking technique which has been successfully introduced in the marketplace under the trade designation "PIN-STAMP". The marking approach employs a series of tool steel punches which are uniquely driven using a pneumatic floating impact concept to generate man readable and/or machine readable dot characters or codes. The marking technique enjoys the advantage of providing characters of good legibility as well as permanence.

Robertson, et al. in U.S. Pat. No. 4,808,018, entitled "Marking Apparatus with Matrix Defining Locus of Movement", issued Feb. 28, 1989, describes a dot matrix character impact marking apparatus which is capable of forming messages or arrays of characters within a very confined region. With this device, a linear array of marker pins is moved by a carriage in a manner defining an undulating locus of movement. During this movement, computer evoked alpha-numeric character strings and the like are generated.

Robertson, et al. in U.S. Pat. No. 5,015,106, issued May 14, 1991, and entitled "Marking Apparatus with Multiple Line Capability" describes a dot matrix character impact marking apparatus which achieves a multiple line capability wherein a carriage component carrying one or more marker pin cartridges moves within a singular plane locus of movement. This multiple line capability has permitted a broad variety of line configurations in widely spaced positions at a workplace. The device further employs a retrace method in generating a locus of marking movement somewhat similar to the formation of a raster in conjunction with television systems.

In U.S. Pat. No. 5,316,397 by Robertson, et al., entitled "Marking Apparatus with Multiple Marking Modes", issued May 31, 1994, a highly versatile marking apparatus and system is described having a flexibility for marking to provide characters in multiple formation modes including the marking of continuous characters as well as dot matrix characters, again utilizing a marker pin based approach.

Single pin marking also has been introduced to industry wherein a pneumatically driven marking pin is maneuvered under a robotic form of control in correspondence with appropriate hardware and software. Such devices are sold, for example, as the Model TMP 6000 marketed by Telesis Marking Systems, Inc. of Chillicothe, Ohio. This software and hardware integrated system provides the capability of maneuvering a marking device along a locus of movement for programmably defining characters and the like within a string.

As these capabilities for computer driven marking of metals and plastics have been introduced and enhanced, industry now has considered the desirability for practical marking systems which can permanently record coded and usually serialized character strings on the surfaces of brittle materials such as glass. The characters of these strings must be adequately small, thus calling for the formation of thin character forming lines. Under consideration by industry are requirements for marking vehicle identification numbers (VIN) on glass auto parts for security and source tracking purposes. Also contemplated is the marking of glass envelopes, for example cathode ray tubes and the like, where it is desirable to record mold source, time, and date data. Such marking, for example with sequential alpha-numeric strings, must be of a level of quality adequate to avoid detracting from the aesthetic properties of the product and, at the same time, achieve the desired permanence developed by indentation formed markings heretofore made in somewhat maleable materials such as metals and plastics. In the latter regard, the marks must be capable of surviving high annealing temperatures while remaining highly visible for machine reading. Where brittle materials such as glass are marked using reciprocating pins or the like, the resultant marks are aesthetically undesirable both from the standpoints of sight and the presence of a "gritty" tactile effect or feel. Of more import, such marking procedures are prone to generate stress risers which tend to weaken glass products, inasmuch as they may become sources of crack propagation.

Preferably, brittle glass products are marked with procedures achieving a subtle "frosting" effect. For the most part, this has been achieved by applying etchants such as hydrofluoric acid or abrasive blast through masks or stencils or by the application of small abrasive grinding wheels, both procedures being overly time consuming and labor intensive. For example, where serialized VIN numbers are to be marked, a separate stencil is required for each application. Following such application, cleaning procedures are required resulting in techniques which are ill suited for mass production procedures.

SUMMARY

The present invention is addressed to apparatus and method for carrying out the efficient marking of brittle materials such as glass. Through the utilization of a stream of gas entrained abrasive particles which is uniquely switched between marking and non-marking orientations, a marking of programmed character sequences is achieved. The resultant characters exhibit both a permanent as well as an aesthetically desirable frosted appearance.

In a preferred embodiment of the invention, the abrasive particle stream switching technique may be carried out in conjunction with the location of the outlet opening of a nozzle from which the particle stream is expressed in close proximity with the surface being marked. This permits efficient marking while achieving a character formation with desirably thin character defining lines. In this regard, the nozzle from which the abrasive particle stream is expressed is maneuvered reciprocably from a marking orientation in close proximity to the surface to be marked and a retracted position locating the particle stream within the diverting influence of the diversionary stream of gas functioning to carry out the switching process.

This diversionary gas stream is located adjacent the particle stream while a particle collecting ledge is positioned opposite the diversionary stream for the purpose of receiving diverted particles. The entire marking and stream switching activity takes place within a suction chamber which continually functions to remove particles expended in the course of marking or having been diverted in a switching action.

As another feature, the invention provides a method for marking the surface of a material with a succession of characters of selected line width in response to a program input. The method comprises the steps of:

providing an abrasive particulate material;

providing a nozzle having an output opening of principal cross-sectional dimension;

providing a programmable drive platform actuable to effect relative movement with respect to the surface to define a locus in response to the program input;

mounting the nozzle upon the platform to impart the relative movement thereto while locating the nozzle and the surface in relative spaced adjacency by positioning the nozzle output opening at a marking distance from the surface selected to derive the select line width;

entraining the abrasive particulate material with a source of gas under pressure and expressing the entrained particles along a marking axis from the output opening as a particulate marking stream directed into the surface;

providing a suction chamber surrounding and extending at least coextensively with the output opening of the nozzle;

providing a source of diversionary gas under pressure having a diversionary gas stream outlet positioned within said suction chamber adjacent the nozzle output opening and located to direct, when actuated, a diversionary gas stream into the particulate stream transversely to the marking axis at a flow rate effective to divert the particles entrained therein away from impingement with the surface to an extent preventing the marking of the surface; and actuating the source of diversionary gas and the programmable drive platform in response to program input to switch the particulate stream between marking and non-marking orientations to form the succession of characters.

Another feature of the invention provides apparatus for marking the surface of materials in response to control inputs with a succession of characters of select line width, the marking being carried out in conjunction with the provision of relative movement between the surface and the drive platform defining a predetermined locus. The apparatus includes a nozzle assembly mountable with respect to the drive platform to provide the locus-defining relative movement with respect to the surface, the assembly having a nozzle portion with an output opening of principal cross-sectional dimension positioned at a marking distance from the surface select to establish the select line width. A suction housing is mounted with the nozzle assembly having an internally disposed suction chamber surmounting the nozzle portion, extending to a suction opening located in spaced adjacency with the surface, and having a vacuum port connectable with a particle receptor at sub-atmospheric pressure. An abrasion source arrangement is actuable for expressing abrasive particles entrained with gas under pressure as a particulate stream from the nozzle output opening along a marking axis to effect formation of the characters by abrasion at the surface. A diversion nozzle assembly is provided having a diversion output located within the suction chamber adjacent to and extensible along the particulate stream, and actuable to express gas under pressure from the diversion output transversely to the marking axis at a flow rate effective to divert the particles entrained within the particulate stream away from impingement with the surface to an extent preventing the marking of the surface. A control arrangement is responsive to the control inputs for actuating the drive platform and the diversion nozzle assembly to effect formation of the characters at the surface.

Still another feature of the invention provides apparatus for marking the surface materials with marks of select lines width by switching on and off a thin stream of gas entrained particles directed toward such surface which comprises a base assembly and a nozzle assembly supported from the base assembly which is connectable with a supply of the particles and gas under pressure. The nozzle assembly has an output opening through which the stream of gas entrained particles is directed along a marking axis, the output opening being located a marking distance from the surface selected to establish the select line width. A suction housing is provided which is supported from the base assembly and has an internally disposed suction chamber extending to a suction opening with an edge positionable in spaced apart adjacency with the surface. A vacuum conduit is connectable with a particle receptor at sub-atmospheric pressure and has an inlet port positioned within the suction chamber. A diversion nozzle assembly is provided having a diversion output located within the suction chamber adjacent to the particulate stream and actuable to express gas under pressure from the diversion output transversely to the marking axis at a flow rate effective to divert the particles entrained within the particulate stream away from the surface to effect the switching off.

Other objects of the invention will, in part, be obvious and will, in part, appear hereinafter.

The invention, accordingly, comprises the method and apparatus possessing the steps, construction, combination of elements, and arrangement of parts which are exemplified in the following detailed disclosure. For a fuller understanding of the nature and objects of the invention, reference should be had to the following detailed description taken in connection with the accompanying drawings.

BRIEF DESCRIPTION OF THE DRAWINGS

FIG. 1 is a perspective view of a marking system according to the invention showing a mounting thereof upon a robotic or programmable drive platform;

FIG. 2 is a representation of the movement of the platform of FIG. 1 to define a sequence of characters;

Figure 6:
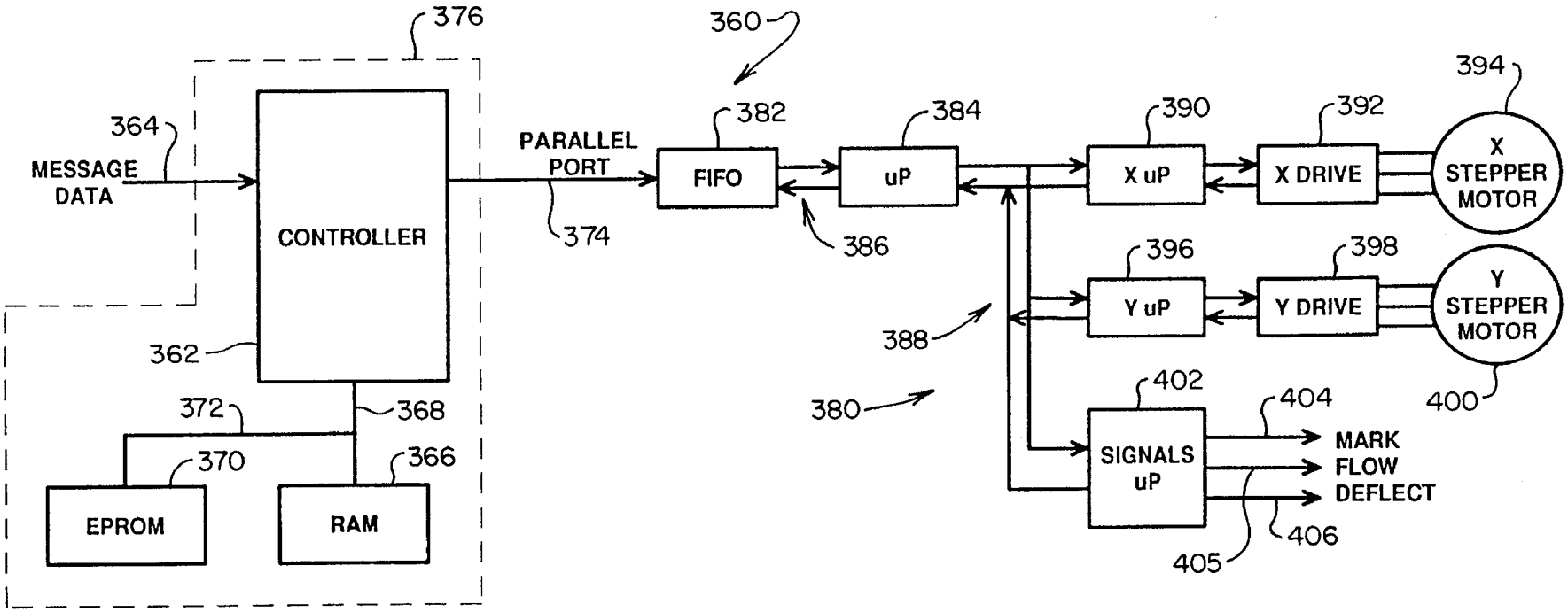

5;

FIG. 6 is a block schematic diagram of a control system employed with the apparatus of FIG. 1;

FIG. 7 is a timing diagram describing the operation of the control system of FIG. 6;

FIG. 8 is a matrix diagram for the character "0";

FIG. 9 is a matrix diagram for the character "1";

FIG. 10 is a matrix diagram for the character "8"; and

FIG. 11 is a matrix diagram for the character "S".

DETAILED DESCRIPTION OF THE INVENTION

The technique and devices for switching a gas entrained stream of abrasive particles generally will be employed with a robotically actuated drive platform performing under computer control. Referring to FIG. 1, one such set-up wherein a marking apparatus according to the invention is mounted upon the programmable drive platform of the robotic system for movement about a surface to be marked is illustrated in general at 10. This set-up 10 is seen to include articulated robot wrist arm components 12, 13, and 14 which typically are driven by stepper motors or the like. A character defining locus of motion is imparted from the platform 14. To this platform component 14 there is attached a support and pneumatic manifold component 16 which is supplied with a gas under pressure such as pressurized air via a flexible conduit 19. Conduit 19 is seen extending to a housing containing solenoid actuated pneumatic valves, a portion of which is represented at 18. Removably coupled to the support 16 by over-center latches 20 and 21 is a nozzle assembly 24 which extends, in turn, to a suction housing 26, below which there is coupled a flexible skirt 28. A suction or vacuum conduit 30 is seen coupled to the suction housing 26 and extending within this conduit 30 is a flexible conduit 32 which carries gas entrained particles from a conventional source (not shown) to a nozzle from which an abrasive marking stream is expressed to form characters. The entire assemblage is seen poised over the surface 34 of a sheet of glass or the like upon which a programmed string of characters are to be marked. Such air entrained particle sources are sometimes referred to as "sandblasters" and are readily available in the marketplace. For example, one such system which may be employed is identified as an "Airbrasive 6500 System" marketed by S. S. White Technologies, Inc. of Piscataway, N.J. 08854-3761.

Referring to FIG. 2, a locus of movement established by the platform component 14 operating in conjunction with the arm 13 for defining the characters: 018S is revealed. In general, the platform 14 will establish a home or start position 36 and then move, without marking as represented by dashed line 38, to a starting position 40, whereupon a locus as represented by the arrow trace 42 is carried out returning to the starting position 40. Then, as represented by dashed line 44, the abrasive marking stream of the set-up 10 is turned off and the assemblage is maneuvered to the recommencement point 46, whereupon the line 48 is marked. Following this trace, as represented by dashed line 50, the abrasive marking stream is turned off and then recommenced at point 52 to commence formation of the number 1. Marking then ensues as represented by the arrow trace 54 until position 56 is reached whereupon, as represented at dashed line 58, the abrasive stream again is turned off until the recommencement position 60 is reached, whereupon the abrasive stream again is turned on to carry out marking until the stop position 62 is reached. Then, as represented by dashed line 64, the marking assemblage is switched off as the platform 14 maneuvers the marking assembly to recommencement position 66, whereupon the arrow trace 68 is followed until a switching off position 70 is reached. The abrasive particle stream marking activity again is switched off at this point and, as represented by dashed line 72, the platform component 14 maneuvers the marking assemblage to commencement position 74, whereupon marking ensues along the arrow trace 76 to stopping position 78. At this position, the abrasion marking activity is switched off and, as represented by dashed line 80, platform 14 maneuvers the marking assemblage to the home or start position 36. As is apparent, the locus thus defined requires a highly abrupt and accurate switching of a particulate stream such that a uniform line is formed which is clearly defined and without the presence of over-shooting "whisks" and like aberrations. The method and apparatus of the invention represents an achievement of such operational criteria.

Figure 3:
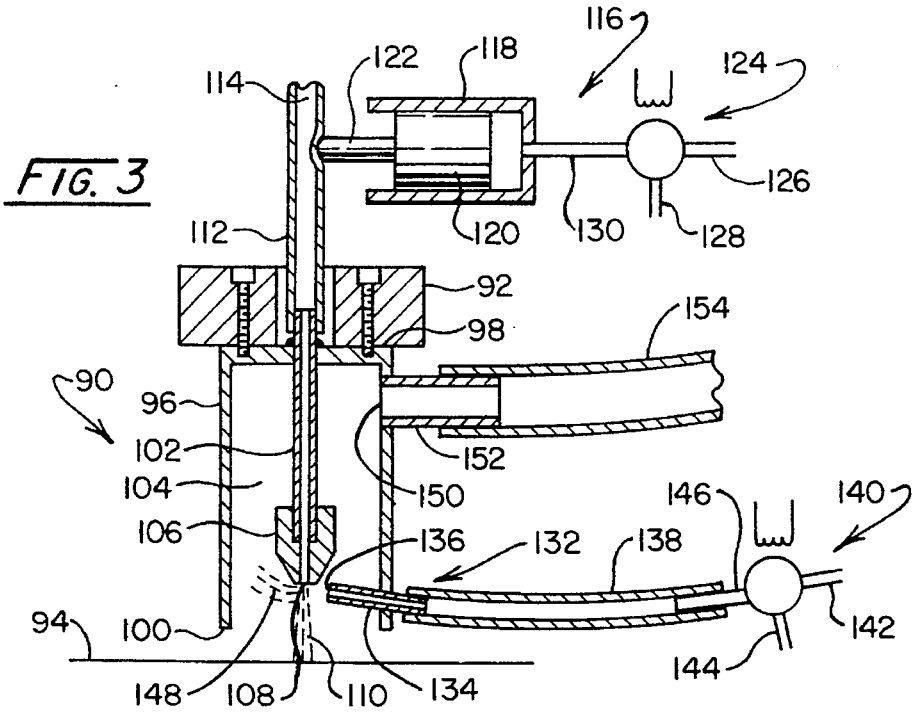
FIG. 3 is a schematic diagram of one embodiment of the invention.

Referring to FIG. 3, an initial and somewhat basic embodiment for apparatus according to the invention which is mountable for movement upon a platform such as that described at 14 is illustrated generally at 90 in conjunction with a schematic representation for the platform 14 as shown at 92 and further in conjunction with a surface 94 to be marked. The apparatus 90 includes a cup-shaped suction housing 96 having a closed top portion 98 attached by machine bolts to the platform 92 and movable therewith. The general shape of housing 96 is one of a cylinder closed at end 98 and open at the opposite end as represented by the edge 100 which is seen to be in spaced adjacency with respect to the surface 94. Extending through and fixed to the top portion 98 is a rigid nozzle conduit 102 which extends within a suction chamber 104 defined by the housing 96 to a nozzle 106. Nozzle 106 is seen to have an output opening 108 of dimension selected for defining the initial principal cross-sectional dimension or diameter of a gas entrained particulate marking stream 110 shown being directed downwardly into an abraiding and thus marking association with the surface 94. Nozzle tube or conduit 102 additionally is seen extending upwardly from the top portion 98 for connection with a flexible tube 112 corresponding with the conduit 32 described in conjunction with FIG. 1 and carrying a gas entrained abrasive particle mixture within its interior 114. In general, the entrained particles will be somewhat fluidized and the gas will be air under pressure, for example 20 psi. A white aluminum oxide powder form of particulate matter having a size of about 50 microns in diameter has been found to provide acceptable marking performance with respect to a glass surface as at 94. In general, the nozzle head 106 is formed of a material which is resistant to abrasion. Ceramic nozzles have been found to be acceptable for this purpose. However, other materials such as rubber which are somewhat abrasion resistant may be employed.

Flow of the gas entrained abrasive particles within the interior 114 of the flexible tube 112 is controlled by a solenoid actuated flow valve 116. Conventionally provided with sandblasting mechanisms, the valve 116 is seen to have a pneumatic chamber housing 118 within which there is positioned a pneumatic piston 120 having a nose or pinch component 122 which pinches off and thereby closes the interior 114 of flexible tubing 112 to stop or start flow as desired. Pneumatic input to the chamber housing 118 is provided by a solenoid actuated pneumatic valve represented schematically at 124. The valve 124 performs in conjunction with a pressurized air input 126, exhaust port 128, and a valve input conduit 130. Thus, upon the orientation of the valve 124 such that the exhaust port 128 is in communication with the chamber of housing 118, the piston 120 is biased rearwardly by a spring arrangement, not shown, to release the interior 114 of tubing 112 for providing flow of gas entrained particles through the tube 102 and outwardly from nozzle 108 to establish the particulate stream 110. Switching of this stream 110 in the rapid manner called for by the application of the instant invention is provided by the provision of a diversion nozzle assembly 132. Assembly 132 is seen to be formed having a tube-like nozzle 134 extending through the suction housing 96 to a diversion output 136 located just below the opening 108 of nozzle 106 and in somewhat close adjacency thereto. The opposite end of tube or nozzle 134 extends from the suction housing 96 for connection with a flexible tube 138 which extends through a solenoid actuated pneumatic valve 140 to a source of gas under pressure, for example, air. As before, the valve 140 is represented schematically and is seen having a conduit component 142 extending to the noted source of air under pressure, an exhaust conduit 144, and an output conduit 146. With the arrangement shown, when the valve 140 is actuated to open and apply air under pressure to the flexible conduit 138, a corresponding diversionary gas flow is expressed under pressure from output 136 to divert the stream 110 from its marking orientation with respect to surface 94 into the suction chamber 104 illustrated by diverted stream representation 148.

To capture this diverted stream of particles 148 as well as particles used in marking surface 94, a vacuum port 150 is located in pneumatic communication with the suction chamber 104. Port 150 is seen coupled with a vacuum tube or suction tube 152 connected to the housing 96 and extending, in turn, to connection with a vacuum conduit 154 which corresponds with the vacuum conduit 30 discussed in conjunction with FIG. 1. Thus, a diversionary gas under pressure from output 136 integrates with the particles of marker stream 110 to derive a diverted stream 148, whereupon the diverted particles as well as those employed for marking are recovered and directed to a particle receptor (not shown) at subatmospheric pressure. Switching of the particulate stream 110 by such diversionary action occurs rapidly as required for the marking maneuvers which are carded out as discussed in conjunction with FIG. 2. While rapid switching action with respect to this particulate stream 110 is achieved, it may be noted that the width of the lines forming a character is defined or determined by the distance from the output 108 of nozzle 106 to the surface 94 as well as by the diameter of opening 108. Particularly to create small size characters, it becomes necessary to decrease line width by decreasing the distance between surface 94 and opening 108.

Figure 4:
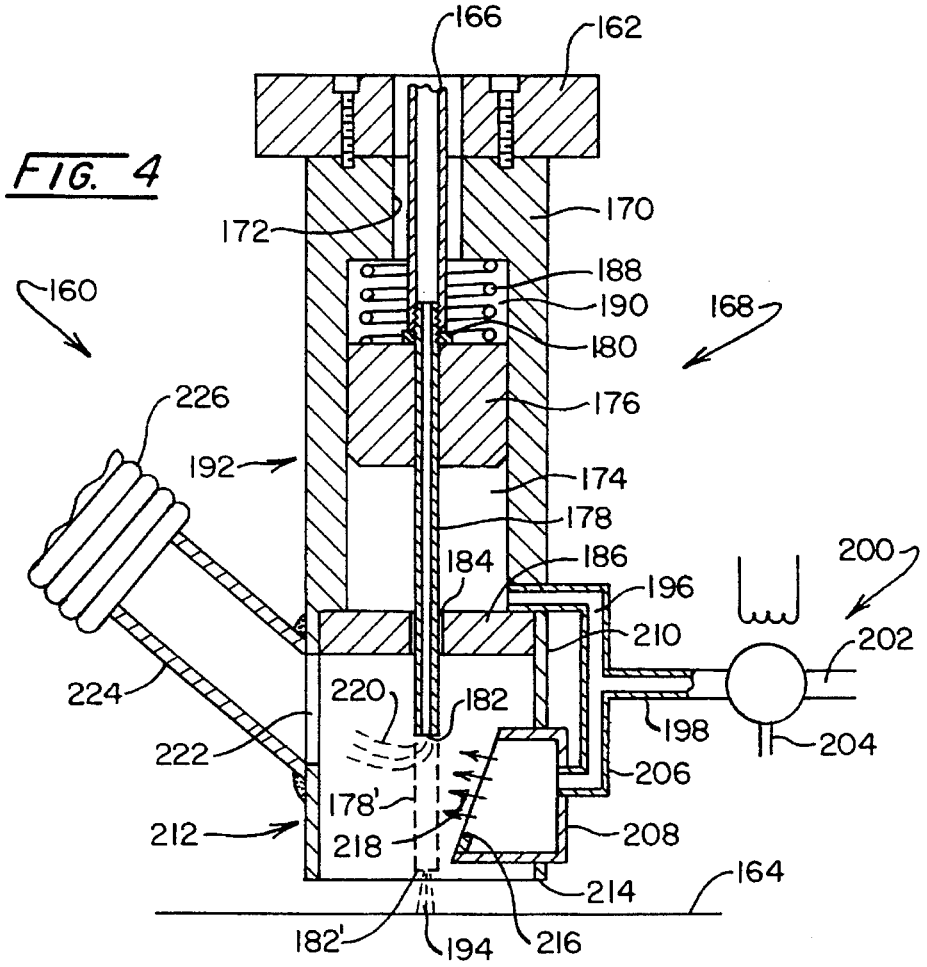
FIG. 4 is a schematic diagram of another embodiment of the invention.

The apparatus 90, as described in conjunction with FIG. 3, is restricted in terms of the width of the lines formed by the marking stream 110. As the particulate stream 110 is expressed from the opening 108, it will tend to widen. Thus, to achieve a thin line width, it becomes necessary to move the opening 108 into close proximity with the surface 94. However, it is also necessary that rapid switching of the stream 110 take place as is achievable with the diversionary gas output directed from the nozzle 134. Looking to FIG. 4, an embodiment of the invention as represented by apparatus 160 is schematically presented wherein the entrained stream particulate output may be positioned very close to the surface to be marked, and still a rapid diversionary stream switching of the particulate material may be realized. Apparatus 160 is supported from a robotic drive platform 162 which corresponds with the final robot component or articulative component 14 described in connection with FIG. 1. This platform 162 moves the apparatus 160 so as to provide relative movement between it and a surface to be marked as represented at 164. Surface 164 corresponds with the surface 34 as described in conjunction with FIG. 1. Apparatus 160 performs in conjunction with an abrasion stream source (not shown) as above described. Accordingly, a flexible tube 166 is provided, one end of which is coupled to the abrasion, source which will, upon appropriate actuation, provide an entrained flow of abrasive particles. To initially control that flow, a pinch valve (not shown) is provided in conjunction with tube 166 as described at 116 in connection with FIG. 3. Attached to the underside of the platform 162 is a nozzle assembly 168 which includes a nozzle assembly housing 170, having an opening 172 through which the flexible conduit 166 may extend. Additionally formed within the housing 170 is a piston chamber 174 within which is disposed a positioning piston 176. Connected to and centrally disposed within the piston 176 is an elongate tubular nozzle 178, the upper end of which is coupled with a tube fitting 180. Fitting 180, in turn, is seen to be connected to one end of flexible tube 166. The opposite end of nozzle 178 provides an output opening shown in exaggerated fashion at 182 through which a stream of gas entrained abrasive particles may be expressed. Elongate tubular nozzle 178 is seen to be slidably positioned within an opening 184 formed within a piston chamber head 186 serving to pneumatically secure the chamber 174.

Positioning piston 176 is seen to be biased to move downwardly by a helical compression spring 188 positioned within an upper chamber 190 of the nozzle assembly housing 170. That piston 176 and the spring 188 form two components of a position drive assembly represented generally at 192 which maneuvers the output opening 182 of the nozzle 178 from a retracted or lift position as shown to a marking position represented in phantom at 178' and 182'. Note that the opening at the marking position represented at 182' is quite close to the surface 164 to be marked. Correspondingly, the particulate stream 194, developed at this close location, is capable of marking desirably thin character forming lines within the surface 164. Piston 176 is retained in the retracted or lift position shown with solid lines in consequence of the introduction of gas under pressure into the piston chamber 174 from a branch pneumatic conduit 196 extending via conduit 198 to a solenoid actuated pneumatic valve represented generally at 200. Valve 200 is provided having an input coupled via schematically represented input conduit 202 to a source of gas such as air under pressure. The exhaust component of the valve 200 is represented schematically at 204. It may be observed that the conduit 198 branches additionally at 206 to provide a gas under pressure input to an elongate diversion nozzle 208 mounted within the cylindrical wall 210 of a suction housing 212. Housing 212 is seen connected to the bottom portion of nozzle assembly 168 and extends to a cylindrical opening defined by edge 214. Edge 214 is seen spaced away from but in adjacency with surface 164 to permit the ingress of air thereinto.

Diversionary nozzle 208 is configured having a narrow, slot-shaped output opening (not shown) which is aligned with the opening 182 of elongate nozzle 178. It is desirable that the device 208 evoke an upwardly directed vector output of a gas such as air under pressure. To promote this vector output, a restriction 216 is positioned in the nozzle which extends upwardly along the noted slot. The result is to provide a diversionary air output having the slightly upwardly disposed vector orientation represented by arrows 218. Typical dimensions for this slot are, for example, 14 mm×1 mm where the latter, width dimension is at least equal to or greater than the diameter of output opening 182. The diversionary air thus presented as represented at vector arrows 218, serves to integrate with and divert the particles entrained within the particulate stream emanating or expressed from opening 182 as represented by the particulate stream 220. The thus-diverted particulate stream 220 is directed toward a suction port 222 formed within the wall 210 of suction housing 212. This port 222 is coupled to a rigid suction conduit connector 224 which, in turn, is coupled to a flexible suction conduit 226 having the same function as earlier described suction or vacuum conduit 30 as illustrated in conjunction with FIG. 1.

With the arrangement shown, it may be observed that with appropriate actuation of solenoid actuated valve 200 to an off condition opening the exhaust port 204, positioning piston 176 will have been driven rapidly downwardly by spring 188 such that the output opening 182 of nozzle 178 has the marking position represented at 182'. However, upon receipt of a lift command, valve 200 again is actuated to close the exhaust conduit 204 and apply pneumatic gas under pressure both to the chamber 174 and to the nozzle 208. Thus, as the nozzle 178 is elevated to its retracted position by piston 176, diversionary gas under pressure exhausts through the output opening of nozzle 208 as represented by vector arrows 218. The result is to rapidly divert the particulate stream 220 into the suction port 222 and thence to the particle supply of the sandblaster or the like utilized with the apparatus. Note that during this maneuver, air or gas under pressure is supplied via conduit 206 to carry out the diversionary operation while being simultaneously supplied through branch 196 to elevate the positioning piston 176.

The utilization of a pneumatic lift via branch conduit 196 with respect to positioning piston 176 achieves a secondary advantage. In this regard, the pneumatic pressure within chamber 174 will tend to self-clean the gap between opening 184 and the outer surface of elongate nozzle 178.

Figure 5:
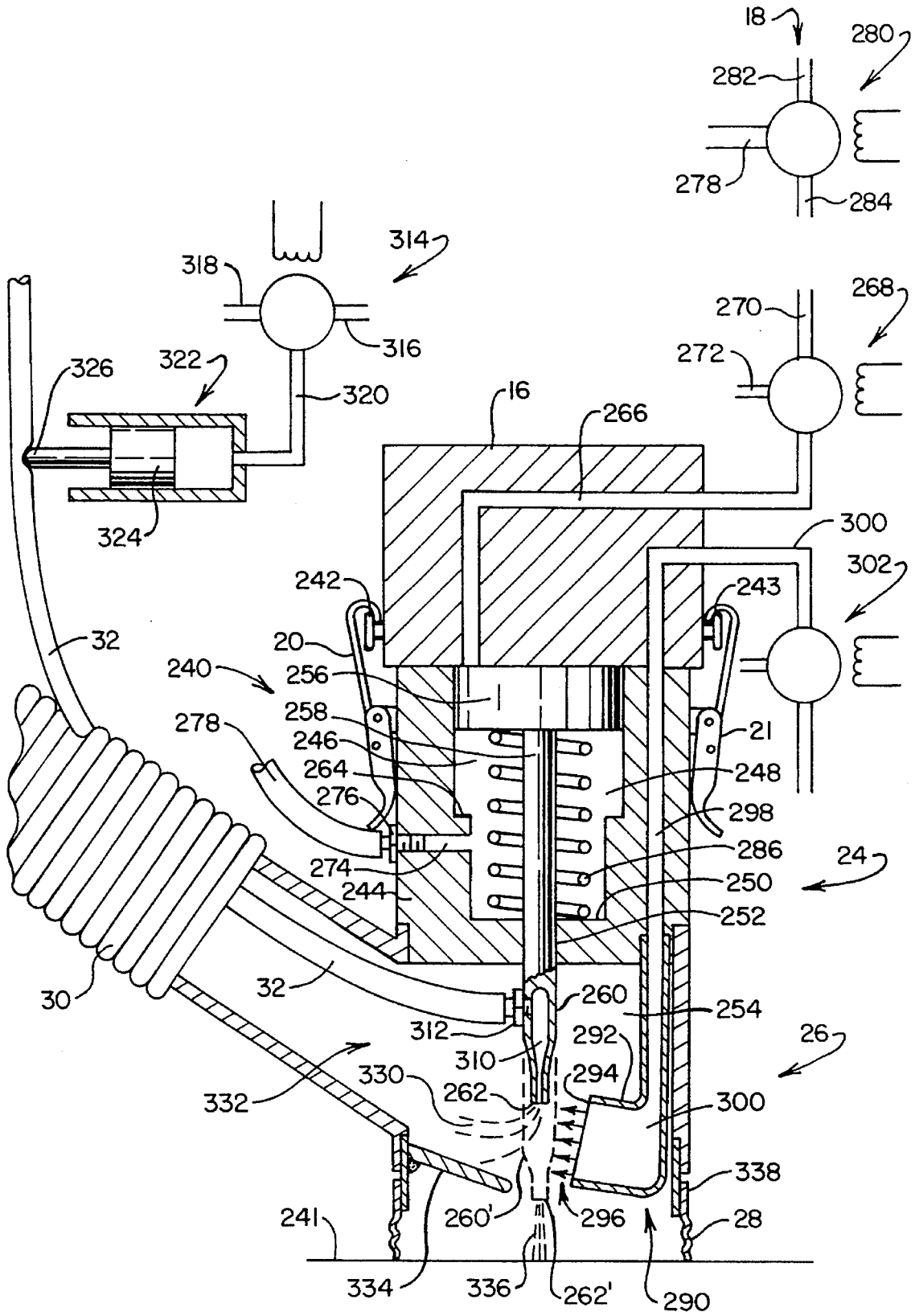
FIG. 5 is a sectional diagram of the embodiment of the invention represented in FIG. 1.

Referring to FIG. 5, a third, preferred embodiment of the apparatus of the invention is revealed in general at 240. Apparatus 240 is closely similar to that described in conjunction with FIG. 1. Accordingly, components of commonality between these two embodiments are represented by the same general numeration. The marking arrangement 240 is intended for connection with a robotic component as at 14 as described in conjunction with FIG. 1. In this regard, the support manifold 16 reappears with the same numeration. Manifold 16 is seen to support two externally disposed connector studs 242 and 243 which may be engaged by the earlier-described over center latches 20 and 21 to retain a nozzle assembly 24 in position thereagainst. Assembly 24 is configured having a nozzle assembly housing 244 within which is located a position drive assembly represented generally at 246. Assembly 246 is incorporated within a piston chamber 248 having a lower disposed portion 250 which extends to an opening 252 serving as a bearing and extending between the lower portion 250 of chamber 248 and the suction chamber 254 of suction housing 26. Suction housing 26 is seen additionally in FIG. 1.

Reciprocally mounted within the piston chamber 248 is a positioning piston 256 which is shown in the figure at its lift or retracted orientation. Fixed to and depending downwardly from the piston 256 is a nozzle support rod 258 which is seen to extend through opening and bearing 252. Rod 258 supports a thin, conically shaped nozzle 260 which may be threadably connected thereto and which is seen having an output opening shown in exaggerated fashion at 262 from which a particulate stream may be expressed. Piston 256 may be pneumatically driven to its marking orientation abutting a shoulder 264 within the chamber 248 by a pneumatic input from pneumatic conduit 266 formed within support/manifold 16. Input conduit 266 extends to a solenoid actuated pneumatic valve represented schematically and generally at 268 which may be one component of a ganged arrangement of such valves as described in general at 18 in connection with FIG. 1. Valve 268 is seen to have an input conduit represented schematically at 270 which is connectable with a source of gas under pressure, as well as an exhaust vent 272. In similar fashion, the piston chamber 248 is coupled via port 274 and fitting 276 with a conduit 278 coupled to the corresponding output 278 of a solenoid actuated pneumatic valve represented in general at 280. In this schematic representation, the flexible conduit 278 is considered to be continuous to the valve 280. Valve 280 is coupled with a source of gas such as air under pressure via an input conduit represented schematically at 282 and may be vented as represented schematically at exhaust conduit 284. The valve, as before, may be one component of the ganged valve grouping 18 described in connection with FIG. 1. With the arrangement shown, an actuation of valves 268 and 280 may be utilized to drive the piston 256 reciprocally within the chamber 248. The pneumatic return arrangement as provided from conduit 278 is preferred for the earlier reasons of providing a clearing or cleaning action at the bearing and opening 252 at the lower chamber portion 250. Alternately, as represented in phantom in the figure, a compression spring 286 may be provided within the chamber 248 at lower portion 250 to provide for lifting and retracting movement at the piston 256.

To carry out switching of the abrasive particle entrained stream expressed from the nozzle opening 262, a diversion nozzle assembly represented generally at 290 is provided. The diversion assemblage 290 is seen formed of a diversion nozzle 292 having a diversion nozzle slot type opening 294 which is aligned within the suction chamber 254 to express gas (air) under pressure at a flow rate effective to substantially divert particles entrained within the particulate stream expressed from nozzle output opening 262. The vectors of such a diversionary gas stream are represented by the arrows at 296. Gas such as air under pressure is supplied to the assembly 290 from conduit 298 formed within nozzle assembly 24. Conduit 298 communicates, in turn, with a conduit represented schematically at 300 which forms the output conduit of a solenoid actuated pneumatic valve represented schematically at 302 and which may form part of the ganged grouping of solenoid valves represented at 18 in FIG. 1.

Figure 5A:
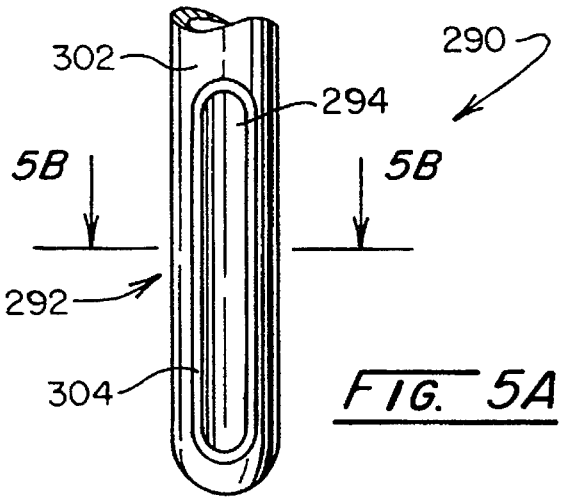
FIG. 5A is a partial plan view of a diversionary nozzle employed with the apparatus of FIG. 5.
Figure 5B:
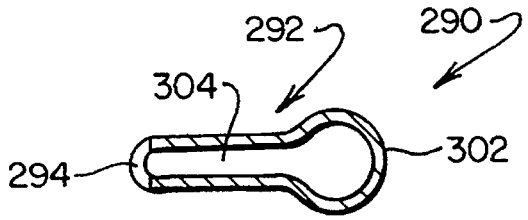
FIG. 5B is a sectional view taken through the plane 5B—5B shown in FIG. 5A.

To evolve the slightly upwardly directed vector air flow represented by arrows 296, the diversion nozzle 292 is canted slightly upwardly, for example about 10° above horizontal and is formed having a rearwardly disposed annular chamber 300. Referring additionally to FIGS. 5A and 5B, this annular chamber 302 is seen to be in communication with a narrow duct component 304 which extends to the slot-like opening 294. The chamber 302 functions as a plenum and serves to feed the duct region 304 leading to opening 294 in a manner achieving the slightly upwardly directed diversionary air flow as represented by vector arrows 296 in FIG. 5.

Entrained abrasive particles are introduced to the internal cavity 310 of nozzle 260 from a conduit fitting 312 attached, in turn, to the earlier-described flexible conduit 32. As noted above, this conduit extends to a source of air entrained abrasive particulate material, i.e. a sandblaster. Flow control of these entrained particles through the conduit 32 is provided by a solenoid actuated pneumatic valve represented generally at 314. Valve 3 14 is seen coupled with a source of pressurized air at an input represented schematically at 316 and has an exhaust port represented schematically at 318. The output of the valve 314 at conduit 320 is shown coupled to a pinch valve assembly represented at 322 having a piston 324 which is pneumatically actuated to drive a nose component 326 into a constricting and pinching off association with the flexible conduit 32. Valve 314 will be seen to respond to open the conduit 32 in conjunction with a "flow" command.

When positioning piston 256 locates the nozzle 260 at the retracted or lift position shown in solid line fashion in FIG. 5, the gas entrained particulate stream expressed from opening 262 is diverted by the diversionary gas flow from diversion nozzle 292 in a manner represented by the dashed particulate stream symbol 330. This diversion is toward the suction port 332 formed as the opening of rigid suction conduit connector 334 which, in turn, is coupled with the flexible suction conduit 30. To assure a complete and effective diversionary switching of the particulate stream as at 330, a ledge as at 334 is mounted within the suction housing chamber 254 adjacent the suction port 332. Ledge 334 improves the switching action of the diversion nozzle 290, avoiding small "wisps" which may otherwise develop in conjunction with character formation at the surface 241. Ledge 334 preferably is formed of a non-abrading material. In this regard, it has been found that the rubber or gum type of substance is resistant to abrasion by the particle stream 330. To carry out a marking procedure, the positioning piston 256 is actuated by appropriate actuation of valves 268 and 280 to move such that its lower surface abuts against the shoulder 264 of chamber 246. This positions the nozzle 260 at the location represented in phantom at 260'. As before, this also positions the nozzle opening 262 at the location represented at 262' to provide a marking particulate stream as represented at 336 in close proximity to the surface 241 to develop a desirably thin marked line. Particulate material rebounding from the surface 241 is recovered through the port 332. To improve the vacuum form of particulate removal, the skirt earlier described in connection with FIG. 1 at 28 is provided. This skin is seen attached to the suction housing 26 by a cylindrical collar 338. Generally, skin 28 will be formed of a fabric material to provide flexibility and resistance to the abrasion necessarily encountered from the particulate material present and active within the suction chamber 254. In the latter regard, the components within the chamber 254 may be coated with a flexible material such as gum rubber or the like elastomeric material to avoid the abrasive effects occasioned by the particulate material circulating within the suction chamber 254. As noted above, these materials are removed through port 332 both following their expression from opening 262' during marking procedures and during a switched off condition wherein they are diverted as represented at 330.

Figure 5C:
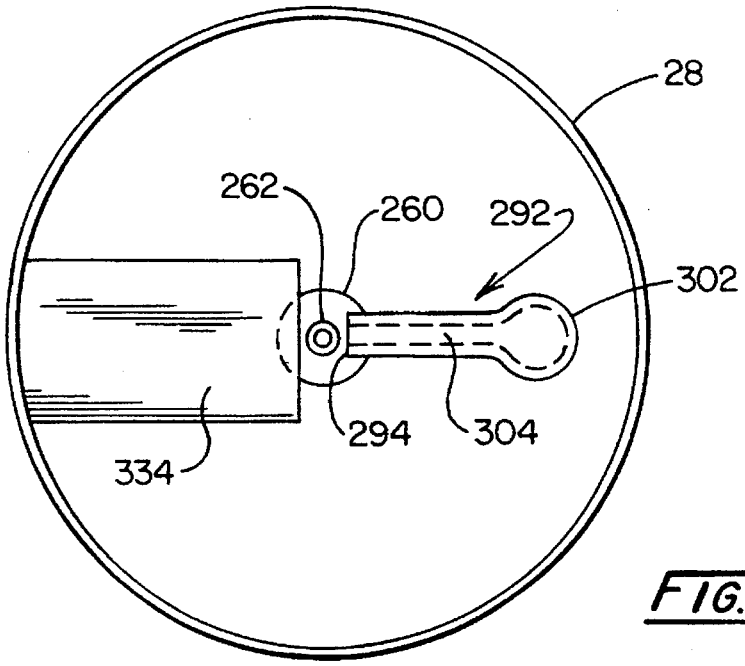
FIG. 5C is a partial bottom view of the apparatus of FIG.

In a typical implementation of the apparatus 240, the opening 262 will have a diametric extent of less than 1 mm and the width of the duct 304 and opening 294 will be slightly greater than 1 mm. As seen in FIG. 5C, opening 294 of the diversionary nozzle 292 is located quite close to the opening 262 of nozzle 260, for example for the dimensions discussed, being about 0.25 mm from the adjacent interior surface thereof. Similarly, the edge of ledge 334 preferably is positioned from the opposite interior surface of opening 262 an equivalent distance of about 0.25 mm. For that particular topology, a typical tube or conduit from which the nozzle 292 is formed will have an outside diameter of about 3.18 mm and an inside diameter of 2.54 mm. The height of the slot-like opening 294 as well as the duct component 304 will be about 15.24 mm and the length of the duct component 304 may be, for example, about 12 mm. Ledge 334 may be provided for the noted dimensions having a width of about 6.35 mm and a thickness of about 2.54 mm. Of course, the particular selection of dimension is determined by the user with respect to line widths desired, character size desired, and the like. In general, when employing aluminum oxide particles having an average diameter, for example of 10 microns, the particle stream as at 336 may be driven from an air pressure of, for example, 15 psig in combination with a diversionary stream of air produced from a 30 psig pressurized air source.

Referring to FIG. 6, a schematic representation of a control system for driving the apparatus 240 is represented, in general, at 360. This overall control 360 includes a microprocessor driven controller represented at 362 which obtains information as to the desired message data through a serial port represented by arrow 364. Such message data includes the desired character string or strings which are to be abrasively marked as well as the font, character size, and x/y location of the string or strings of character information. Controller 362 is supported in conventional fashion by random access memory (RAM) 366 as represented by bus line 368. Additionally, the controller program as well as font path data are retained in a non-volatile read only memory (EPROM) as represented at 370, the association of that memory with controller 362 being represented at line 372. From the controller 362, as represented at parallel port (arrow) 374, coded signals are presented to four marker control and x/y platform controllers. As an alternative arrangement, all of the functions associated with the controller 362 may be performed by a personal computer (PC) as represented by the dashed boundary 376. In this regard, the message data at 364 may derive from either a host download, bar-code scanner data, or from a personal computer keyboard entry. For a personal computer embodiment, the non-volatile memory including program and fonts as developed at EPROM 370 would be retained in disk memory. Advantage accrues in the utilization of a personal computer by virtue, for example, its capability for providing a graphics screen and modern programming aids including pull-down menues, mouse selection, keyboard editing, and the like. Such programming may be used to facilitate the creation of the desired message patterns with respect to their location, font selection, sizes, speeds, and the like. The controlling output at parallel port 374 provides coded commands which are directed to a printer-sequencer function represented generally at 380. The commands from port 374 initially are buffered by a first in-first out (FIFO) device such as a register as at block 382 which is unloaded a command at a time by an embedded controller or microprocessor function 384. As represented by the interactive arrow pair 386, the controller 384 interprets each command and then, depending upon the command type at hand, directs the requested action through an appropriate control activity. These activities are represented by the arrow grouping represented generally at 388 and include an embedded controller or microprocessor 390 which controls an x-axis stepper drive and x-axis drive network 392 which selectively energizes an x-axis stepper motor 394. Similarly, an embedded controller or microprocessor 396 controls a y-axis stepper drive as represented at block 398 which, in turn, serves to selectively energize a y-axis stepper motor represented at 400. Finally, coded commands are provided from microprocessor or controller 384 to a dedicated signals controller or microprocessor represented at block 402. This microprocessor provides parallel control signals as represented at lines 404–406 which, respectively, provide the control signals "mark", "flow", and "deflect". The mark command causes the apparatus 240 to lower nozzle 260 to the operative position shown at 260'. This is as opposed to a lift or "not mark" signal which would retract the nozzle utilizing positioning piston 256. The "flow" signal serves to turn on abrasive flow from a location usually downstream near the particle-air source or sandblaster. This valve is represented in FIG. 5 at 314. Finally, a "deflect" signal serves to turn on deflecting air from the nozzle 290 by appropriate actuation of the valve 302.

Referring additionally to FIG. 7, a timing diagram is presented illustrating an exemplary sequence of control operations.

As a first step in this sequence, the controller 362 produces a command through parallel port 374 which turns on DEFLECT as represented at 410. This starts lateral air flow from nozzle 290.

As a second step, the controller 362 produces a command through parallel port 374 which turns on or commences the "FLOW" command. This starts a flow of air entrained abrasive particles by opening the pinch valve described in FIG. 5 at 314. The FLOW command commencement is represented in FIG. 7 at 412.

As a third step, the controller 362 determines the number of x and y steps which are required to move the platform 14 (FIG. 1) from its "home" or last position to the first marking position within the first character. These commands are passed through parallel port 374. Movement to this home position is represented in FIG. 7 at 414.

As a fourth step, the controller 362 produces a command through the parallel port 374 which causes sequencing controller 380 to pause the unloading of marking sequence commands from FIFO 382 for a time which will permit the establishment of stable abrasive flow or entrained particulate flow so that the first character to be formed will be identical to the following characters. It may be noted that the time required for the previous move to first marking location within the first character will affect the duration of this pause. The pause itself is represented at 416. As a fifth step, the controller 362 produces a signal through the parallel port 374 which provides the "MARK" command causing the positioning piston 256 to lower the nozzle 260 to its marking orientation 260'. The platform 14 also is caused to move through pixel locations of the desired characters. In this regard, while the motion is continuous and the resultant lines forming characters are continuous, the program looks to a pixel matrix definition of each of the characters in generating commands for platform 14 movement,as well as for deflecting the particle stream in a switching maneuver. In this regard, for the example described in connection with FIG. 2, the character "0" will include a "mark not" or "lift" command in the course of its formation as represented by the curved components 418 and 420 shown in FIG. 7. Looking to FIG. 8, the matrix defined formation of the character, 0, is described. The matrix exemplified in FIG. 8 as well as those markers illustrated in subsequent. FIGS. 9 through 11, are selected as "7×9", nine rows being identified and numbered from the bottom row upwardly to the ninth row and seven columns being identified by numbering from left to right. Thus, to form the character "0" as seen in FIG. 8 and described in connection with FIG. 2, a sequence of marking and lifting maneuvers are called for as represented in Table I. In the table and those tables to follow, a column is identified initially followed by a decimal point and a row designation. For example, in FIG. 8, the marking commences at column 2, row 9. The term "LIFT" in the tables represents an elevating of the nozzle 260 and resultant diversion of the marking stream to switch off the marking activity.

TABLE I

| Move from Home or Last Character while Lifted (not Mark) | | | |
|---|---|---|---|
| 2.9 TO 3.9 --MARK | → | 3.9 TO 4.9 --MARK | → |
| 4.9 TO 5.9 --MARK | → | 5.9 TO 6.9 --MARK | → |
| 6.9 TO 7.8 --MARK | → | 7.8 TO 7.7 --MARK | → |
| 7.7 TO 7.6 --MARK | → | 7.6 TO 7.5 --MARK | → |
| 7.5 TO 7.4 --MARK | → | 7.4 TO 7.3 --MARK | → |
| 7.3 TO 7.2 --MARK | → | 7.2 TO 6.1 --MARK | → |
| 6.1 TO 5.1 --MARK | → | 5.1 TO 4.1 --MARK | → |
| 4.1 TO 3.1 --MARK | → | 3.1 TO 2.1 --MARK | → |
| 2.1 TO 1.2 --MARK | → | 1.2 TO 1.3 --MARK | → |
| 1.3 TO 1.4 --MARK | → | 1.4 TO 1.5 --MARK | → |
| 1.5 TO 1.6 --MARK | → | 1.6 TO 1.7 --MARK | → |
| 1.7 TO 1.8 --MARK | → | 1.8 TO 2.9 --MARK | → |
| 2.9 TO 1.2 --LIFT | → | 1.2 TO 2.3 --MARK | → |
| | | 2.3 TO 3.4 --MARK | → |
| 3.4 TO 4.5 --MARK | → | 4.5 TO 5.6 --MARK | → |
| 5.6 TO 6.7 --MARK | → | 6.7 TO 7.8 --MARK | → |
| Lift Prior to Move to Next Character or Home | | | |

The formation of the character "1" also involves a lift procedure as represented in FIG. 7 at curves 422 and 424. The pixel mapped movement for the platform 14 with respect to this character is represented in FIG. 9. Looking to that figure and Table II, the sequence of maneuvers forming the character are described.

TABLE II

| Move From Home or Last Character While Lifted (not Mark) | | | |
|---|---|---|---|
| 3.9 TO 4.9 --MARK | → | 4.9 TO 4.8 --MARK | → |
| 4.8 TO 4.7 --MARK | → | 4.7 TO 4.6 --MARK | → |
| 4.6 TO 4.5 --MARK | → | 4.5 TO 4.4 --MARK | → |
| 4.4 TO 4.3 --MARK | → | 4.3 TO 4.2 --MARK | → |
| 4.2 TO 4.1 --MARK | → | 4.1 TO 3.1 --MARK | → |
| 3.1 TO 2.1 --MARK | → | | |
| 2.1 TO 6.3 --LIFT | → | | |
| 6.3 TO 6.2 --MARK | → | 6.2 TO 6.1 --MARK | → |
| 6.1 TO 5.1 --MARK | → | 5.1 TO 4.1 --MARK | → |
| Lift Prior to Move to Next Character or Home | | | |

In similar fashion, the third figure, "8" as described in connection with FIG. 2, is formed in accordance with the mark diagram 426 in FIG. 7. The pixel definition of the character is shown in FIG. 10 along with arrows indicating the direction of platform movement as described in conjunction with FIG. 2. Table III describes the pixel-to-pixel movement for the formation of this character. It may be noted that no lift commands are required in connection with the formation of the character "8".

TABLE III

| Move from Home or Last Character While Lifted (not Mark) | | | |
|---|---|---|---|
| 2.5 TO 2.6 --MARK | → | 2.6 TO 2.7 --MARK | → |
| 2.7 TO 2.8 --MARK | → | 2.8 TO 2.9 --MARK | → |
| 2.9 TO 3.9 --MARK | → | 3.9 TO 4.9 --MARK | → |
| 4.9 TO 5.9 --MARK | → | 5.9 TO 6.9 --MARK | → |
| 6.9 TO 6.8 --MARK | → | 6.8 TO 6.7 --MARK | → |
| 6.7 TO 6.6 --MARK | → | 6.6 TO 6.5 --MARK | → |

TABLE III-continued

| Move from Home or Last Character While Lifted (not Mark) | | | |
|---|---|---|---|
| 6.5 TO 7.5 --MARK | → | 7.5 TO 7.4 --MARK | → |
| 7.4 TO 7.3 --MARK | → | 7.3 TO 7.2 --MARK | → |
| 7.2 TO 7.1 --MARK | → | 7.1 TO 6.1 --MARK | → |
| 6.1 TO 5.1 --MARK | → | 5.1 TO 4.1 --MARK | → |
| 4.1 TO 3.1 --MARK | → | 3.1 TO 2.1 --MARK | → |
| 2.1 TO 1.1 --MARK | → | 1.1 TO 1.2 --MARK | → |
| 1.2 TO 1.3 --MARK | → | 1.3 TO 1.4 --MARK | → |
| 1.4 TO 1.5 --MARK | → | 1.5 TO 2.5 --MARK | → |
| 2.5 TO 3.5 --MARK | → | 3.5 TO 4.5 --MARK | → |
| 4.5 TO 5.5 --MARK | → | 5.5 TO 6.5 --MARK | → |
| Lift Prior to Move to Next Character or Home | | | |

Finally, the character "S" as described in conjunction with FIG. 2 is represented as being formed in conjunction with timing diagram 428 as shown in FIG. 7. The pixel definition of this character is represented in FIG. 11. As shown in the following Table IV, the character "S" is formed without a lift command.

TABLE IV

| Move from Home or Last Character While Lifted (not Mark) | | | |
|---|---|---|---|
| 1.3 TO 2.2 --MARK | → | 2.2 TO 3.1 --MARK | → |
| 3.1 TO 4.1 --MARK | → | 4.1 TO 5.1 --MARK | → |
| 5.1 TO 6.2 --MARK | → | 6.2 TO 7.3 --MARK | → |
| 7.3 TO 6.4 --MARK | → | 6.4 TO 5.5 --MARK | → |
| 5.5 TO 4.5 --MARK | → | 4.5 TO 3.5 --MARK | → |
| 3.5 TO 2.6 --MARK | → | 2.6 TO 1.7 --MARK | → |
| 1.7 TO 1.8 --MARK | → | 1.8 TO 2.9 --MARK | → |
| 2.9 TO 3.9 --MARK | → | 3.9 TO 4.9 --MARK | → |
| 4.9 TO 5.9 --MARK | → | 5.9 TO 6.9 --MARK | → |
| 6.9 TO 7.8 --MARK | → | | |
| Lift Prior to Move to Next Character or Home | | | |

A more detailed discourse of the movement of a marker in accordance with matrix defined characters is provided in the above-noted U.S. Pat. No. 5,316,397 entitled "Marking Apparatus with Multiple Marking Modes".

At the end of a string of characters, the command "MARK" is again turned off as represented in FIG. 7 at 430. Additionally, the platform 14 is returned to a home position or stopped in the case of bi-directional printing.

As a seventh general step, the controller 362 then produces a command after the last character stroke through parallel port 374 which turns off the "FLOW" command as represented in FIG. 7 at 432. This command is implemented by the actuation of valve 314 as described in conjunction with FIG. 5.

Then, as an eighth general step, the controller 362 produces a command through the parallel port 374 which turns off the "DEFLECT" command when the home location is reached by platform 14. The removal of this command is represented in FIG. 7 at 434 in conjunction with the final movement of platform 14 to its home position as represented at 436 in the same figure. Terminating the deflection flow as represented at 434 serves to conserve air in an industrial environment and eliminates a "hissing" noise otherwise evoked in the operation of the apparatus 240. Ideally, the DEFLECT is turned off with sufficient time delay following the turn off of FLOW and MARK as represented at respective positions 432 and 430 to eliminate any errent marking.

Since certain changes may be made in the above-described method and apparatus without departing from the scope of the invention involved, it is intended that all matter contained in the description thereof or shown in the accompanying drawings shall be interpreted as illustrative and not in a limiting sense.

We claim:

1. The method for marking the surface of a material with a succession of characters of select line width in response to a program input comprising of characters of select line width in response to a program input comprising the steps of:

providing an abrasive particulate material;

providing a nozzle having an output opening of principal cross sectional dimension;

providing a programmable drive platform actuable to effect relative movement with respect to said surface to define a locus in response to said program input;

mounting said nozzle upon said platform to impart said relative movement thereto while locating said nozzle and said surface in relative spaced adjacency by positioning said nozzle output opening at a marking distance from said surface selected to derive said select line width;

entraining said abrasive particulate material with a source of gas under pressure and expressing said entrained particles along a marking axis from said output opening as a particulate marking stream directed into said surface;

providing a suction chamber surrounding and extending at east coextensively with said output opening of said nozzle;

providing a source of diversionary gas under pressure having a diversionary gas stream outlet positioned within said suction chamber adjacent said nozzle output opening and located to direct, when actuated, a diversionary gas stream into said particulate stream transversely to said marking axis at a flow rate effective to divert said particles entrained therein away from impingement with said surface to an extent preventing the marking of said surface; and actuating said source of diversionary gas and said programmable drive platform in response to said program input to switch said particulate stream between marking and non-marking orientations to form said succession of characters.

2. The method of claim 1 including the step of:

evacuating by suction said particles diverted from said particulate stream from the vicinity of said surface.

3. The method for marking the surface of a material with a succession of characters of select line width in response to a program input comprising the steps of:

providing an abrasive particulate material;

providing a nozzle having an output opening of principal cross sectional dimension;

providing a programmable drive platform actuable to effect relative movement with respect to said surface to define a locus in response to said program input;

mounting said nozzle upon said platform to impart said relative movement thereto while locating said nozzle and said surface in relative spaced adjacency;

entraining said abrasive particulate material with a source of gas under pressure and expressing said entrained particles along a marking axis from said output opening as a particulate marking stream directed into said surface;

providing a source of diversionary gas under pressure having a diversionary gas stream outlet adjacent said nozzle outlet and located to direct, when actuated, a diversionary gas stream into said particulate stream transversely to said marking axis at a flow rate effective to divert said particles entrained therein substantially away from impingement with said surface;

actuating said source of diversionary gas and said programmable drive platform in response to said program input to switch said particulate stream between marking and non-marking orientations to form said succession of characters;

said step of locating said nozzle and said surface in relative spaced adjacency being carried out by positioning said nozzle at a marking distance from said surface selected to derive said select line width; and said step of locating said nozzle and said surface in relative spaced adjacency being preceded by the steps of locating said nozzle remotely from said surface, and actuating said source of diversionary gas, then positioning said nozzle at said marking distance.

4. The method of claim 3 including the steps of:

providing a ledge substantially adjacent said nozzle opening above said surface when at said marking distance therefrom and located oppositely from said diversionary gas stream outlet;

said diversionary gas stream diverting particles entrained within said particulate stream above said ledge; and evacuating by suction said particles diverted from said particulate stream from said ledge.

5. Apparatus for marking the surface of materials in response to control inputs with a succession of characters of select line width, said marking being carried out in conjunction with the provision of relative movement between said surface and a drive platform defining a predetermined locus, comprising:

a nozzle assembly mountable with respect to said drive platform to provide said locus defining relative movement with respect to said surface having a nozzle portion with an output opening of principal cross-sectional dimension positioned at a marking distance from said surface selected to establish said select line width;

a suction housing mounted with said nozzle assembly having an internally disposed suction chamber surmounting and extending over said nozzle portion, extending to a suction opening located in spaced adjacency with said surface, and having a vacuum port connectable with a particle receptor at subatmospheric pressure;

abrasion source means actuable for expressing abrasive particles entrained with gas under pressure as a particulate stream from said nozzle output opening along a marking axis to effect formation of said characters by abrasion at said surface;

a diversion nozzle assembly, having a diversion output located within said suction chamber adjacent to and extensible along said particulate stream, and actuable to express gas under pressure from said diversion output transversely to said marking axis at a flow rate effective to divert said particles entrained within said particulate stream away from impingement with said surface to an extent preventing the marking of said surface; and control means responsive to said control inputs for actuating said drive platform and said diversion nozzle assembly to effect formation of said characters at said surface.

6. Apparatus for marking the surface of materials in response to control inputs with a succession of characters of select line width, said marking being carried out in conjunction with the provision of relative movement between said surface and a drive platform defining a predetermined locus, comprising:

a nozzle assembly mountable with respect to said drive platform to provide said locus defining relative movement with respect to said surface having a nozzle portion with an output opening of principal cross-sectional dimension;

a suction housing mounted with said nozzle assembly having an internally disposed suction chamber surmounting said nozzle portion, extending to a suction opening located in spaced adjacency with said surface, and having a vacuum port connectable with a particle receptor at subatmospheric pressure;

abrasion source means actuable for expressing abrasive particles entrained with gas under pressure as a particulate stream from said nozzle output opening to effect formation of said characters by abrasion at said surface;

a diversion nozzle assembly, having a diversion output located within said suction chamber adjacent to and extensible along said particulate stream, and actuable to express gas under pressure from said diversion output at a flow rate effective to substantially divert said particles entrained within said particulate stream away from impingement with said surface;

a ledge mounted within said suction housing chamber adjacent said nozzle output opening and oppositely disposed from said diversion output of said diversion nozzle assembly, said ledge being configured for directing particles diverted by said diversion nozzle assembly into said suction opening; and control means responsive to said control inputs for actuating said drive platform and said diversion nozzle assembly to effect formation of said characters at said surface.

7. The apparatus of claim 6 in which said suction housing vacuum port is located in adjacency with said ledge for recovering said diverted particles received by said ledge.

8. Apparatus for marking the surface of materials in response to control inputs with a succession of characters of select line width, said marking being carried out in conjunction with the provision of relative movement between said surface and a drive platform defining a predetermined locus, comprising:

a nozzle assembly mountable with respect to said drive platform to provide said locus defining relative movement with respect to said surface, having a nozzle portion with an output opening of principal cross-sectional dimension, and including a position drive assembly coupled with said nozzle portion, actuable to move said nozzle portion along a path of movement between retracted and marking positions, said marking positions locating said nozzle portion output opening at a marking distance from said surface selected to derive said select line width;

a suction housing mounted with said nozzle assembly having an internally disposed suction chamber surmounting said nozzle portion, extending to a suction opening located in spaced adjacency with said surface, and having a vacuum port connectable with a particle receptor at subatmospheric pressure;

abrasion source means actuable for expressing abrasive particles entrained with gas under pressure as a particulate stream from said nozzle portion output opening to effect formation of said characters by abrasion at said surface;

a diversion nozzle assembly, having a diversion output located within said suction chamber adjacent to and extensible along said particulate stream, actuable to express gas under pressure from said diversion output at a flow rate effective to substantially divert said particles entrained within said particulate stream away from impingement with said surface, said diversion nozzle assembly being configured for diverting said particles only in the region of said path of movement and not when said nozzle portion is at said marking position; and control means responsive to said control inputs for actuating said drive platform and said diversion nozzle assembly to effect formation of said characters at said surface.

9. The apparatus of claim 8 in which said nozzle assembly and said suction housing are removably mountable upon said drive platform.

10. The apparatus of claim 8 in which said position drive assembly comprises:

a drive chamber having an abrasives conduit guide port;

a positioning piston reciprocably movable within said chamber between retracted and advanced positions;

a rigid nozzle support coupled in driven relationship with said positioning piston having a forward end extending in slideable relationship through said conduit guide port to support said nozzle for reciprocal movement between said retracted and marking positions corresponding with said positioning piston retracted and advanced positions; and drive means coupled with said drive chamber and actuable by said control means to effect said movement of said positioning piston.

11. The apparatus of claim 10 in which said drive means pneumatically drives said positioning piston from said advanced to said retracted position.

12. The apparatus of claim 11 in which said control means includes an electromagnetically actuated valve actuable to apply a source of gas under pressure simultaneously to said drive means to drive said positioning piston to said retracted position and to apply gas under pressure to said diversion nozzle assembly to effect said expression of gas from said diversion output.

13. Apparatus for marking the surface of materials with marks of select line width by switching on and off a thin stream of gas entrained particles directed toward such surface, comprising:

a base assembly;

a nozzle assembly supported from said base assembly, connectable with a supply of said particles and gas under pressure, having a nozzle with an output opening through which said stream of gas entrained particles is directed along a marking axis, said output opening being located a marking distance from said surface selected to establish said select line width;

a suction housing, supported from said base assembly, having an internally disposed suction chamber extending to a suction opening with an edge positionable in spaced apart adjacency with said surface;

a vacuum conduit connectable with a particle receptor at subatmospheric pressure and having an inlet port positioned within said suction chamber; and a diversion nozzle assembly having a diversion output located within said suction chamber inwardly of said edge adjacent to said particulate stream and actuable to express gas under pressure from said diversion output transversly to said marking axis at a flow rate effective to divert said particles entrained within said particulate stream away from said surface to effect a said switching off.

14. The apparatus of claim 13 in which said vacuum conduit inlet port is located at said suction chamber opposite said diversion output.

15. Apparatus for switching on and off a thin stream of gas entrained particles directed toward a surface, comprising:

a base assembly;

a nozzle assembly supported from said base assembly, connectable with a supply of said particles and gas under pressure, having a nozzle with an output opening through which said stream of gas entrained particles is directed;

a suction housing, supported from said base assembly, having an internally disposed suction chamber extending to a suction opening positionable in spaced apart adjacency with said surface;

a vacuum conduit connectable with a particle receptor at subatmospheric pressure and having an inlet port positioned within said suction chamber;

a diversion nozzle assembly having a diversion output located within said suction chamber adjacent to said particulate stream and actuable to express gas under pressure from said diversion output at a flow rate effective to substantially divert said particles entrained within said particulate stream away from said surface to effect a said switching off; and a ledge mounted within said suction housing suction chamber at a location disposed oppositely from said diversion output, said ledge being configured for directing particles diverted by said gas expressed under pressure from said diversion output into said inlet port.

16. Apparatus for switching on and off a thin stream of gas entrained particles directed toward a surface, comprising:

a base assembly;

a nozzle assembly supported from said base assembly, connectable with a supply of said particles and gas under pressure, having a nozzle with an output opening through which said stream of gas entrained particles is directed and including a position drive assembly coupled with said nozzle, actuable to move said nozzle along a path of movement between retracted and advanced positions, said advanced position locating said nozzle output opening a select distance from said surface;

a suction housing, supported from said base assembly, having an internally disposed suction chamber extending to a suction opening positionable in spaced apart adjacency with said surface;

a vacuum conduit connectable with a particle receptor at subatmospheric pressure and having an inlet port positioned within said suction chamber; and a diversion nozzle assembly having a diversion output located within said suction chamber adjacent to said particulate stream and actuable to express gas under pressure from said diversion output at a flow rate effective to substantially divert said particles entrained within said particulate stream away from said surface to effect a said switching off, said diversion output being configured for diverting said particles substantially throughout said movement of said nozzle along said path, said stream of gas entrained particles being without the influence of said gas expressed from said diversion output when said nozzle is at said advanced position.

17. The apparatus of claim 16 including a ledge mounted within said suction housing suction chamber at a location disposed oppositely from said diversion output in substantial adjacency with said nozzle output opening when said nozzle is at said advanced position, said ledge being configured for directing particles diverted by said gas expressed under pressure from said diversion output into said inlet port.

18. The apparatus of claim 17 in which said ledge is configured having an upwardly disposed, particle receiving surface located in particle transfer communication with said vacuum conduit inlet port.

19. The apparatus of claim 17 in which said suction housing at said suction opening and said ledge are configured having surfaces of elastomeric material selected for resistance to abrasion occasioned by said particles.

20. The apparatus of claim 17 in which said diversion output of said diversion nozzle assembly is configured having surface of elastomeric material selected for resistance to abrasion occasioned by said particles.

* * * * *